US005128595A

United States Patent [19]

Hara

[11] Patent Number: 5,128,595

[45] Date of Patent: Jul. 7, 1992

[54] FADER FOR MINIATURE LIGHTS

[75] Inventor: Kanichi Hara, Taipei, Taiwan

[73] Assignee: Minami International Corporation, New York, N.Y.

[21] Appl. No.: 602,366

[22] Filed: Oct. 23, 1990

[51] Int. Cl.[5] ..... H05B 37/00; H05B 41/00

[52] U.S. Cl. ..... 315/312; 315/200 A; 315/323; 307/11; 362/806

[58] Field of Search ..... 315/312, 323, 200 A; 307/41, 38, 39, 11; 362/806

[56] References Cited

U.S. PATENT DOCUMENTS

| | | | |
|---|---|---|---|
| 3,521,124 | 7/1970 | Bogner | 315/312 |
| 3,789,211 | 1/1974 | Kramer | 315/195 |
| 3,793,531 | 2/1974 | Ferrigno | 307/41 |
| 3,862,434 | 1/1975 | Davis, Jr. | 307/132 |
| 3,946,244 | 3/1976 | Davis, Jr. | 307/31 |
| 4,215,277 | 7/1980 | Weiner et al. | 307/41 |
| 4,264,845 | 4/1981 | Bednarz | 315/312 |
| 4,284,926 | 8/1981 | Dinges | 315/312 |
| 4,558,403 | 12/1985 | Llerandi | 315/323 |
| 4,678,926 | 7/1987 | Davis | 307/11 |
| 4,780,621 | 10/1988 | Bartleucci et al. | 307/11 |
| 4,890,000 | 12/1989 | Chou | 307/36 |

OTHER PUBLICATIONS

Circuit & Design Ideas, Lan Pogson, Electronic, Aust., Nov. 1980.

*Primary Examiner*—Eugene R. LaRoche
*Assistant Examiner*—Tan Dinh

[57] ABSTRACT

An ornamental lighting control system capable of controllably adjusting the intensity of the lights over a relatively long period of time. The fully electronic means for gradually energizing the lights includes a ramp voltage generator whose output is synchronized to a power line zero crossing by a detector means coupled to the ramp voltage generator. The ramp means, in combination with a triangular wave generator and a comparator, achieve adjustable long time constants for controllable fading of the associated lights. The lighting control system can, additionally, be configured to compensate for any non-linearities in the incandescent light strings driven by the system.

16 Claims, 6 Drawing Sheets

FADER FOR MINIATURE LIGHTS

BACKGROUND OF THE INVENTION

1. Field of the Invention

This invention relates to Christmas tree lighting systems utilizing a plurality of strings of lights which can be separately actuated and specifically to a Christmas tree lighting control system that allows the brightness of each string of lights connected to it to change slowly in accordance with a user supplied manual adjustment. When light strings having different colored bulbs in each string are used the slow change in brightness or fading of each strings allows the controlled lights to give a special effect wherein the sequential actuation of successive differently colored light strings can slowly modify the color and appearance of the Christmas tree they are placed upon.

2. Description of the Related Art

It is well know to use decorative light sets having a plurality of separately actuatable strings of lights wherein a controller activates the various light strings either simultaneously or alternatively. Typically, the bulbs in each string are caused to cycle on and off in order to provide a more interesting appearance. However, often the sudden on/off action of the flashing lights gives an unduly harsh and unpleasant appearance especially when a whole string of multiple lights is flashed on and off. This problem is prevalent especially when the tree is not being admired but rather only the reflection of the light from the flashing lights is being perceived involuntarily in the same room. As is the case with any on and off light source, such a flashing stimulus might be distracting and generally unpleasant. Furthermore, because of the violent on/off action, the lamp filaments are thermally shocked This thermal shock comes from the repeated full power application and its inherent heat generation within the filament and subsequent rapid cool off of the filament during power off conditions. It is therefore desirable to have a fading effect associated with the operation of the lights so the transition from a full OFF to a full ON condition and from a full ON to a full OFF condition is more gradual.

The on/off and fading concepts of control of decorative lights in the prior art is exemplified by Ferrigno U.S. Pat. No. 3,793,531, issued Feb. 19, 1974, Weiner et al U.S. Pat. No. 4,215,277 issued July 29, 1980, Davis U.S. Pat. No. 4,678,926 issued July 7, 1987, Bartleucci et al U.S. Pat. Nos. 4,780,621 issued Oct. 25, 1988, and McNair U.S. Pat. No. 4,888,494 issued Dec. 19, 1989.

Ferrigno, U.S. Pat. No. 3,793,531, a proponent for fader operation of lights, describes a TRIAC activated power control system using a variable rate oscillator to determine the duration of the conduction angle of the TRIAC, thereby controlling the AC power level, or brightness of lights controlled therewith. The oscillator can be set for frequencies greater than, but close to 60Hz, the powerline frequency This produces a slow variation in average power to the load at a "beat" frequency equal to the difference between the power line frequency and that of the oscillator. The cycle time, or period between "full" brightness and "low" brightness operation is dependent on the difference between the power line frequency and that of the variable rate oscillator (col 5, line 58–65). Such a fading scheme requires that the variable rate oscillator be quite stable over time for the fading effect to be constant.

Weiner et al U.S. Pat. No. 4,215,277 discusses an on/off system that discloses a controller for sequentially energizing a plurality of light strings, e.g. Christmas tree light strings The controller is characterized by the use of a plurality of solid state switches or TRIACS, each TRIAC being connected in series between a 110 volt AC power supply and a light string comprised of multiple incandescent lamps. The TRIACS are controlled by a programmable ring counter which energizes the TRIACS in a determined sequence. The counter, in turn, is switched by clock pulses supplied by a variable oscillator at a rate which can be varied by the user. When the TRIAC is energized, i.e. on, it applies the 110 volt AC supply voltage to the light string connected thereto thus energizing all of the lamps on the string in an identical manner.

For example, assuming four lamps, L1–L4 as shown in FIGS. 4–7 of the '277 Patent, these lamps may be energized in a repeating sequence of L1, L2, L3 L4, L3, L2, etc., or in a repeating sequence of L1, L2, L3, L4, L1, L2, L3 etc. The FIG. 5 embodiment permits the sequence L1, L1 L2, L1 L2 L3, L1 L2 L3 L4, L1 L2 L3 L4, and OFF to be continuously repeated. Various other sequences are disclosed with respect to FIGS. 4–7. However, the '277 Patent does not disclose circuitry for producing a gradual intensity change for each light string, nor does it provide circuitry for producing an adjustable overlap between the energized light strings.

Davis, U.S. Pat. No. 4,678,926 describes generally a Christmas tree lighting control system wherein the light output of an internal light source is modulated by a mechanically rotated baffle having certain apertures to excite a set of photoelectric cells. The photoelectric cells in turn modulate the operation of the TRIAC based power control units that activate each individual light string.

The control circuitry disclosed in the '926 Patent includes an electro-mechanical assembly (see FIG. 2) having a motor 11 which slowly turns a patterned baffle 27 to expose, at predetermined time intervals, four photocells 30 positioned behind the rotating baffle 27 to light from lamp 12. The varying output from each of the photocells 30 controls duty cycle units 17–20 to change output power in accordance with the output of their respective photocells 30. The output of the duty cycle units controls strings of ornamental lights which are connected to conductor cord 9. As baffle 27 rotates, the light strings are controlled in intensity and duration in proportion to the photocell output.

Bartleucci et al U.S. Pat. No. 4,780,621 describes a means for controlling low voltage light emitting diodes (LED's) to achieve an on/off flashing effect. A counter divider is included in the controlling means having multiple binary stages, i.e. an output every 2, 4, 8 or 16 pulses from an oscillator operating between 20 and 130 Hz. (col 3, line 41). Because the oscillator output can be divided by the counter divider by a factor of 2, 4, 8 or 16, the effective frequency available to drive the TRIACS, assuming an input of 120 Hz, is 60, 30, 15 and 7½ Hz. Therefore the fixed intensities of the lamps controlled by the TRIACS will be in the ratio of 1, ½, ¼ and ⅛ respectively.

Each set of lamps is comprised of light emitting diodes (LEDs) LEDs of different color are connected in two parallel groups with opposite polarity on the same string, with the light string being energized by a TRIAC. Various effects may be obtained depending upon the specific gating of the TRIACs. For example, if the TRIAC is gated on only during the positive half cycle of the alternating current (AC) energizing voltage, only one of the two groups of LED's will be energized to emit light. Alternatively, if the TRIAC is gated on only during the negative half cycle of the AC voltage, then only the second group of LEDs will turn on. Thus, the string of LEDs may be energized to first blink green, then blink red. As the on-state of the triac shifts relative to the AC voltage, the energization of the first and second LED groups will vary to gradually change color.

FIG. 4 of the '621 Patent shows the TRIAC gating pulses (Output "A"), in various phase relationships to the 60 Hz voltage. As the phase relationship changes, the light string goes from a starting condition in which LED1 is on and LED2 is off, to an intermediate condition where both LEDs are on at full intensity, to a condition where LED1 is off and LED2 is on, and so on. The '621 Patent also discloses the use of a tri-color light emitting diode to produce light which appears to gradually drift from a first color to a second color to a third color (See Col. 5, lines 47 et seq.). The circuitry disclosed and claimed in the '621 Patent is limited to utilizing the non-linear operating characteristics of LEDs, and could not be utilized in the same manner with conventional incandescent lamps.

McNair, U.S. Pat. No. 4,888,494, again an example of ON/OFF light operation, describes an electromechanical switching device where either a first or second electrical load is switched in on/off fashion in response to mechanical cam motion. The rate of the cam rotation can be controlled manually.

The above art generally discusses means for on/off or fading activation of strings of lights by the use of TRIAC control or regular mechanical switches. One aspect of the art related to the fading of lights that poses a challenge is the high stability requirement of some of the techniques using an oscillator near the power line frequency to interact with the powerline frequency to control the state of illumination of the lights, as in Ferrigno. This interaction between the external oscillator and the power line has to be stable over time to achieve a predictable fading effect. The high stability requirement implies that the parts used for the oscillator must be of relatively high cost.

It is, therefore, an object of the present invention to provide an improved, stable, cost effective Christmas tree lighting control which when in operation will ramp the brightness of a string of lights up and down in a repeatable and stable fashion over a period of tens of seconds, thereby allowing the appreciation of sequential illumination of multi-colored strings of lights on a pleasant level without the discontinuities present in a harsh on and off flashing system.

Another object of the present invention is to provide a Christmas tree lighting system wherein the lights are not shocked thermally by violent, nearly instantaneous on/off operation but rather subjected to a slow, continuous increasing and decreasing power level that extends the heating and cooling cycle of each individual lamp over many seconds. This reduced rate of rise in temperature extends the operating life of the lamps by reducing the effects of thermal cycling.

It is a further object of the present invention to provide a light string control system which can readily vary the overlap between activation of the various light strings with respect to other strings of lights in the system.

It is still a further object of the present invention to provide a control unit which can be used with separate strings of conventional lights to obtain the gradual control of illumination of the light strings, thereby giving the appearance of fading overlap of the various strings.

It is yet another object of the present invention to provide an integral control unit permanently coupled to multiple light strings to control their fading characteristics.

Yet another object of the invention is to provide a separate conveniently packaged control unit with standardized sockets to allow connection of several light strings thereto.

BRIEF DESCRIPTION OF THE INVENTION

In accordance with these and other objects and features of the present invention, the present invention is a fully electronic, ornamental lighting control system having a plurality of light strings connected to a fully electronic means for sequentially energizing each of the light strings in a gradual manner. The fully electronic means for the gradual energizing of the light strings has a ramp voltage generator whose output is synchronized to the power line zero crossing by a zero crossing detector means coupled to the ramp voltage generator. The amplitude of the voltage output from the ramp generator is manually adjustable by the user to establish the voltage range over which the ramp generator operates. There is also a triangle wave generator, whose generally triangular output is derived from a free running oscillator, a counter divider and a low pass filter. By adjusting the oscillating frequency of the solid state oscillator, the period of the triangle wave generator can be adjusted manually by the user. The system includes a power control means, responsive to the power control pulse generated by the control pulse generator. This power control means, once triggered, will conduct power to the load from the power line for the duration of the power line half cycle in which the power control pulse was received. One such power control means is provided for each string of lights that is controlled. There is also a control pulse generator that compares the output voltage levels of the ramp voltage generator to that of the triangle wave generator described in (a) and (b) above, respectively. A power control pulse for each power control means is output by this generator whenever a pre-defined set conditions, or relationship exists between the outputs from the triangle wave generator and the ramp voltage, as, for example, whenever the ramp voltage exceeds the triangle wave voltage.

The above components constituting the controller are typically mounted on a printed circuit board and packaged in an enclosure having one or more access holes to allow passage of a control knob for manual adjustment of the fading effect and/or lamp brightness. The enclosure can either be provided with a series of female connectors for plugging strings of lights into the controller or is constructed and arranged with the sets of strings of lights permanently connected to the controller. Each string of lights may be made up of either all one color lights or mixed colors.

Unlike the prior art, the present invention does not use mechanical devices such as motors driving cams or partially opaque disks, or oscillators operating near the power line frequency to increase and decrease the intensity of lights, i.e fade the lights, over a period of time of many seconds. In contrast, the present invention uses a predetermined interaction between a voltage ramp generator synchronized to the power line half cycles and a high frequency oscillator whose output is divided by a counter/divider to establish a stable time interval of the fading effect in the order of 1 to 100 seconds. This interval or period is the time between the full "ON", maximum intensity of the lights, through full "OFF", when the lights are at the lowest intensity, and back to full "ON".

The above ramp generator is started every time a zero line crossing signal is output by a zero line crossing detector associated with it. The zero line crossing detection is typically performed by an optical isolator working in conjunction with a full wave rectifier driving the light emitting diode of the opto-isolator of the crossing detector. The ramp generator is typically made up of a resistor/capacitor combination or a current source /capacitor combination. The range of voltage swing over which the ramp generator operates can be manually adjusted with a resistive control.

The triangle wave generator is made up of a high frequency oscillator and a converter divider and one or more low pass filters. The high frequency oscillator, independent of the power line frequency, can be either pre-set to operate at any convenient frequency substantially above the power line frequency, as for example between 0.5 to 50 Khz, or it can be adjusted manually to operate over a frequency range determined by the manual inputs set by the user.

The counter/divider processing the output of the oscillator can be pre-set or programmed to count out the necessary number of pulses from the oscillator to derive "long" output pulses, for example, every 15 seconds or so. Furthermore, more than one "long" pulse can be concurrently output from the oscillator for each of a number of power control modules. The timing of the concurrent pulses can be chosen so that both their length, for example 15 seconds, their period, for example 45 seconds, and the interval between concurrent pulses, or phasing, for example, is also 15 seconds. By changing the frequency of the oscillator, the duration and period of the pulses can be modified. By changing some of the counter characteristics, the phasing, i.e. interval between concurrent running pulses, can also be modified.

Each output of the counter/ divider drives a low pass filter to output a quasi triangular voltage waveform with or quasi-linear rise and fall times tailored by the choice of components making up the filter. The fall time characteristics of the triangular waveform are determined by elements in the filter that respond to the falling edge of the output from the counter /divider. The rise time characteristics are determined by the filter elements that respond to the rising output edge of the counter/divider. These rise and fall characteristics are chosen in conjunction with the duration of the "long" pulses.

This triangular voltage waveform is compared at the inputs of the control pulse generator to the voltage ramp generated in synchronism for every half power line cycle. Depending upon the meeting of a criterion for the result of this comparison, a power control pulse is generated at a predetermined time within the power line half cycle. Typically, this comparison can be conducted with a single comparator or operational amplifier meaning that the magnitudes of the voltages are compared prior to the generation of the power control pulse. Alternatively, the sensing of the two quantities by the control pulse generator could be performed such that a pre-set difference between the voltage level of one pulse and the other is the criterion for initiating the power control pulse. Other characteristics of the inputs that may be compared in the implementation of the control pulse generator to meet a certain criterion to trigger the output of a power pulse are rate of rise of one waveform as compared to the other, or the integral over time of one waveform as compared to the other, etc.

The power control means is capable of connecting the light or strings to the AC power line upon receipt of a power control pulse from the control pulse generator. Generally, the control signal is generated once per power line cycle. A . typical device used for power control means is a TRIAC.

BRIEF DESCRIPTION OF THE DRAWINGS

The above brief description as well as further objects and advantages of the present invention will be more fully understood by reference to the following detailed description of the presently preferred, albeit illustrative embodiments of the present invention when taken in conjunction with the accompanying drawing wherein.

PREFERRED EMBODIMENT

Figure 1:
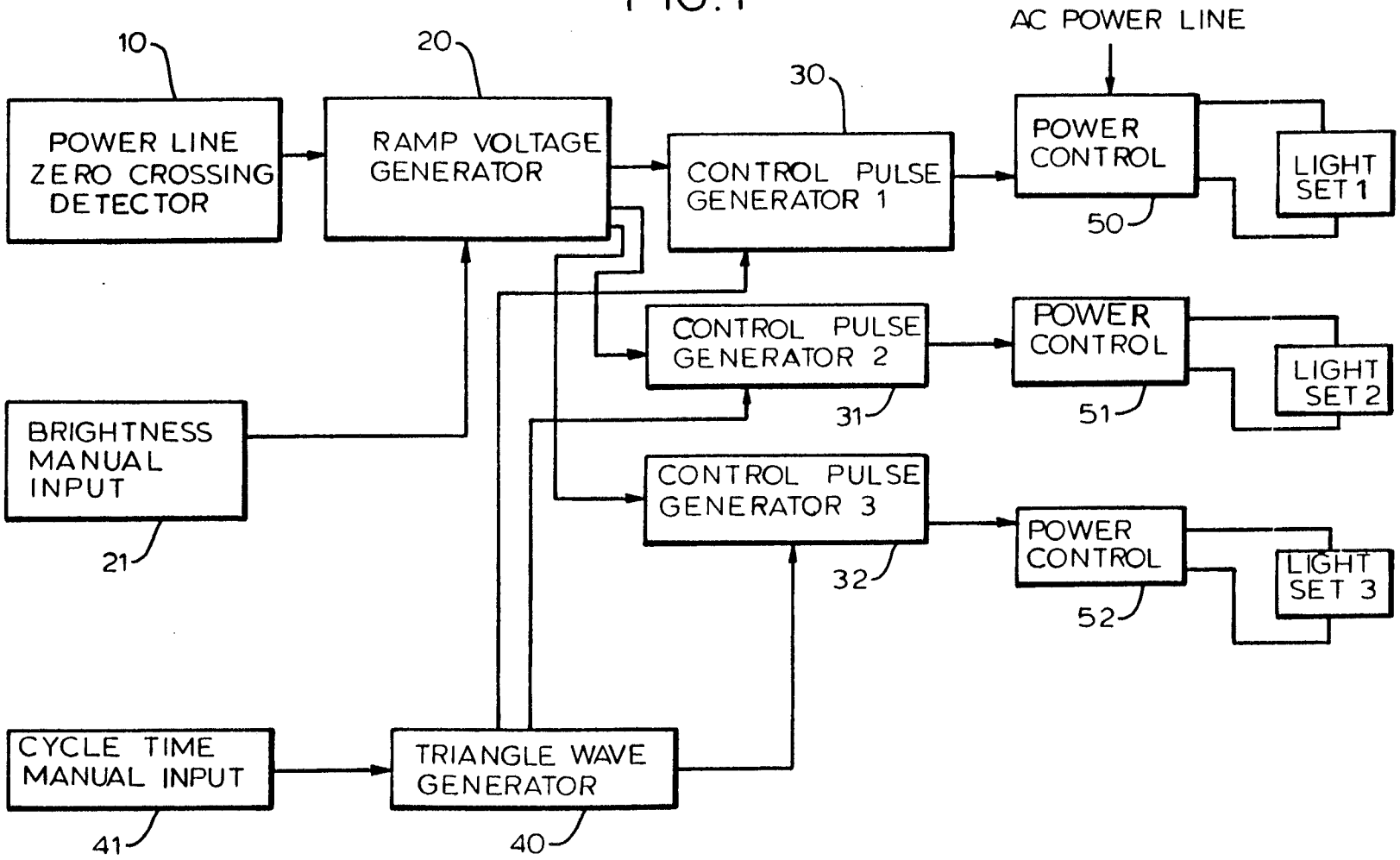
FIG. 1 shows a block diagram of the fader control.

Referring now to the drawing and in particular to FIG. 1 thereof, here is shown a block diagram of the present invention. Block 10 detects the zero crossing of the power line waveform and provides synchronization (timing) information for the operation of the ramp voltage generator 20. Ramp voltage generator 20 combines the timing information from 10 and inputs from the manual brightness control input 21 to establish the voltage excursion range over which the ramp will operate. In essence, the output from 20 is a ramp whose minimum voltage will vary in response to the manual setting of control 21. The result is that the power line frequency zero crossing is used to initiate a rising voltage signal (a ramp).

Unlike control 21, cycle time manual input 41 works in conjunction with triangle wave generator 40 to establish the desired duration of the time interval between maximum and minimum voltage of a triangle wave. The triangle wave generator is free running and unlike ramp voltage generator 20, is not synchronized to the power line.

The relatively long period triangle wave output from generator 40 is used as a reference voltage for control pulse generator 30 to compare the ramp voltage generated from 20. As explained later, this will determine where along the power cycle the power controls 50, 51, 52 are to begin conduction.

Finally, control pulse generator 30 compares the information from 20 and 40 to generate the timing of the necessary pulses to drive each of the power controls 50, 51, 52 in accordance with a pre-selected criterion twice per AC power line cycle.

Figure 2:
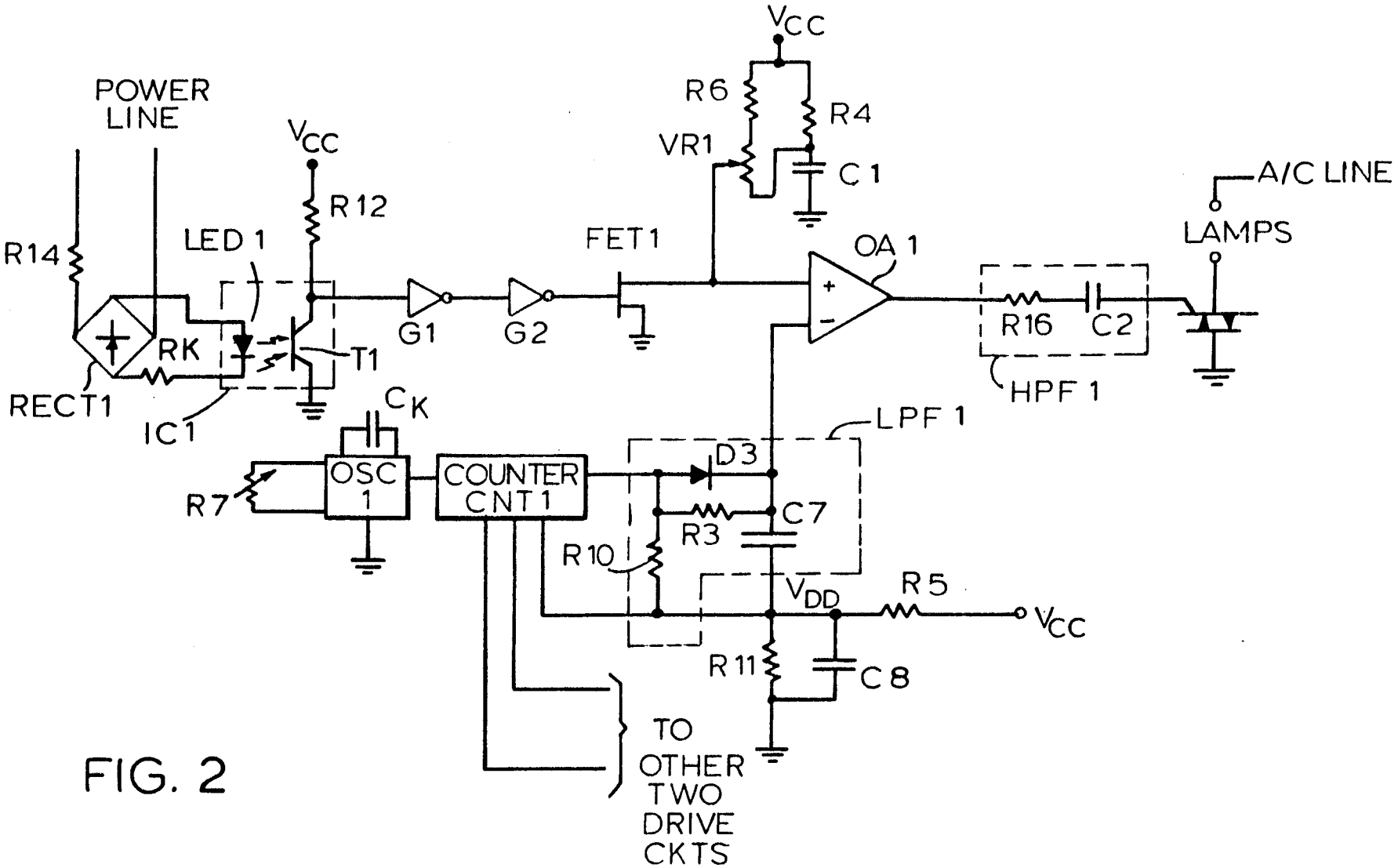
FIG. 2 shows an electrical schematic for an example of an implementation of above block diagram.
Figure 3:
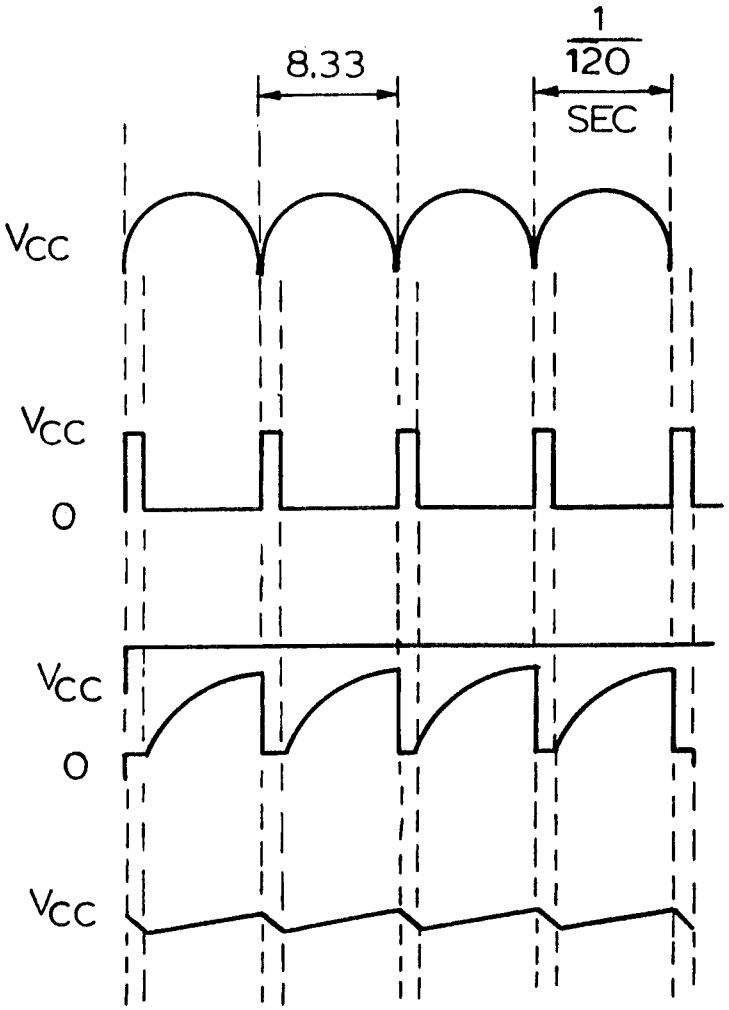
FIG. 3 shows some representative waveforms present at various points of the circuit and their relative timing with respect to the power line waveform.
Figure 4:
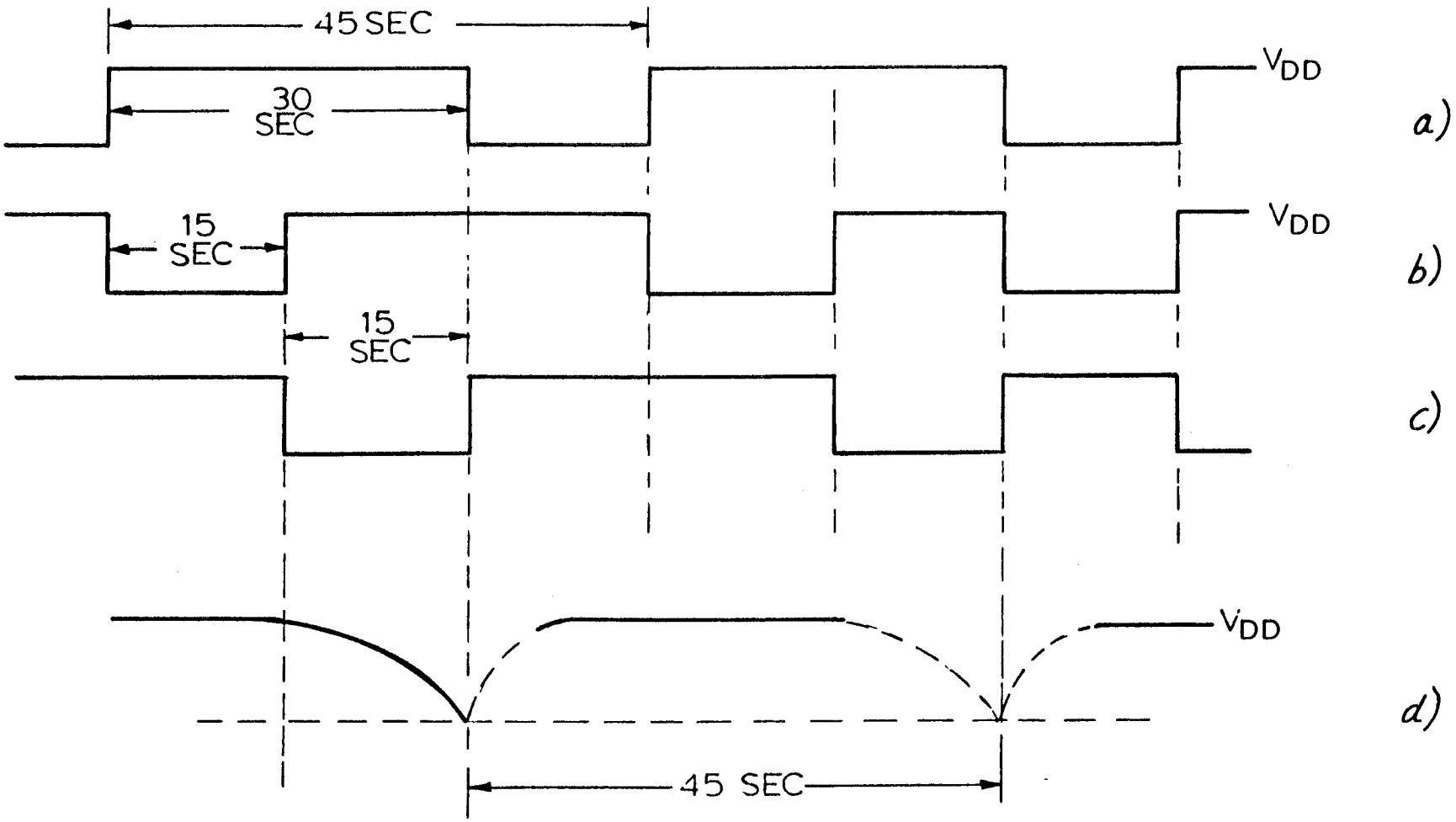
FIG. 4 shows the phase relationship between three exemplary 45 second period timing signals and their modification after passage through a low pass filter.

A typical implementation of above system is shown in the schematic diagram in FIG. 2 and related waveform diagrams are shown in FIGS. 3 and 4.

The zero crossing detection corresponding to item 10 in FIG. 1 is implemented by elements R14, RECT1, LED1, R12, RK and T1 in FIG. 2. Here full wave rectifier RECT 1 working through current limiting resistor R14 excites the light emitting diode LED 1 part of optoisolator IC1 once for each AC power line half-cycle. The voltage waveform across resistor RK with line power applied is shown in FIG. 3, part a. As soon as LED1 conducts sufficiently near the beginning of the AC cycle to bring T1 into conduction, the voltage at the junction of collector of T1 and R12 will drop from approximately Vcc (positive power supply voltage) to near ground level. i.e. ground plus the saturation voltage of collector to emitter voltage of transistor T1. This condition will prevail until the cycle of the power line reaches again its zero line crossover point. Close to the zero crossover point, with LED1 no longer conducting, T1 will no longer be in saturation and its Vce, collector to emitter voltage, will reach approximately Vcc. Thus a signal is generated at the input of gate G1 corresponding essentially to the beginning of each half power cycle, as shown in FIG. 3, waveform b.

The ramp voltage generator 20 consists of gates G1 and G2, field effect transistor FET 1, variable resistor VR1, fixed resistors R4 and R6, and capacitor C1. The pulse generated by the transitions of T1's collector from Vcc to its saturation voltage Vce are transformed (buffered) by gates G1 and G2 into pulses driving field effect transistor FET 1. FET 1 will therefore go into full conduction during the time T1 is OFF i.e. Vce of T1 is high and FET 1 is ON once per power line half-cycle, near the zero crossing point as shown in FIG. 3*b*. FET 1 can be viewed as a switch that connects ground, the source connection, to its drain terminal. FET 1's function could be performed with a transistor or any other device that starts to conduct current in response to a control input.

Turning now to the operation of VR1, note that its function is to control the voltage swing of the ramp output by 20. When VR1, the fade control input is manually set near zero, its wiper resistance measured to C1, R4 junction is minimum (VR1=0). Now FET 1 will completely discharge capacitor C1 at the zero crossing of each power line half cycle because of pulses from T1. For the duration of the rest of the power half cycle while FET 1 is off, resistor R4 will charge capacitor C1 from source Vcc, thereby generating a ramp voltage at C1 from zero volts up to some fraction of Vcc as shown in FIG. 3, c. When VR1 is set at its other extreme, FET 1 will be unable to discharge C1 through the full resistance of VR1 during the relatively short time FET 1 is on. This will result in C1's voltage being close to Vcc for as long as VR1 is at or near its high extreme as shown in FIG. 3*d*. For intermediate values of VR1, the charging ramp of C1 will be progressively closer to the condition explained for VR1=0 ohms above. At one end of the manual control, this adjustment will allow the voltage swing to be at its maximum i.e. the ramp can rise from near zero volts to the positive power supply rail (Vcc). At the other end of the manual control for example, the voltage ramp will be limited to rise from just a fraction of a volt below Vcc to Vcc over the duration of the power line half cycle. For a typical implementation for 60Hz operation, C1 is 0.82 microfarads, R4 and R6 are 220 kohms and VR1 is 5 ohms.

Turning now to the operation of the triangle wave generator 40 in FIG. 1, note that its function is to generate multiple, in this example three, quasi triangular, concurrent waveforms each having an approximate 45 second period to be used by each of three control pulse generators 30,31,32 and respective power control units 50,51 and 52 as shown in FIG. 1. To achieve this, generator 40 is supplied from its own, lower, decoupled voltage source Vdd derived from Vcc. Here, Vcc is about 12 volts. Vdd is generated in FIG. 2 from the voltage divider made up of resistors R5 (3.5 kohms) and R11 (2.2 kohms) and decoupled by capacitor C8 (10 microfarads). Vdd supplies power to oscillator OSC1 and counter CNT1 in FIG. 2 thereby insuring that the upper limit of the output of triangle wave generator 40 does not exceed Vdd, or about 8 volts.

There are three components in the triangle wave generator 40 that in combination produce the three triangular waveforms: the oscillator OSC1, the counter CNT 1 and three low pass filters. Only one low pass filter, LPF1 is shown in FIG. 2 because the other two are topologically generally the same, although their characteristics could be modified to accommodate three different triangular waveform characteristics.

The first component of 40, oscillator OSC1 in FIG. 2, has a square wave output of 10 khz compatible with the input of counter CNT1, and adjustable over the range of 0.5 to 50 Khz. The frequency of OSC1 can be changed by variable resistor R7 in conjunction with capacitor CK. It is well known in the art how to construct oscillators whose frequency can be changed by adjustment of an external resistor. Such an oscillator can be made from an NE 555 timer manufactured by Signetics and other manufacturers. Alternatively, other oscillators such a Wien bridge type, or fully integrated on a silicon chip may also be employed.

The second component of 40, counter CNT1 in FIG. 2, concurrently outputs the illustrative waveforms (internal to 40) shown in FIGS. 4 *a,b,* and *c*. Each waveform has a period of 45 seconds (adjustable over the range of 1 to 100 seconds) and has a rising and falling edge spaced by 15 seconds. Each of the three waveforms' rising edges are spaced sequentially from the other (phased) by 15 seconds.

The digital output pulses of the oscillator OSC1 are divided down, or counted, by counter CNT1 so that the three waveforms shown in FIGS. 4 at *a,b,* and *c* are produced. This method of creating three staggered waveforms such as these from a single oscillator input is well known in the art and is generally described in "Digital Logic Design" by B. Holdsworth chapters 6 and 7. These illustrative waveforms, shown as if the low pass filters made up of R10, R3, D3 and C7 were not present, rise to a peak of Vdd volts, which in this example is less than Vcc, the power supply positive rail.

Each of the three waveforms from CNT1 drive the third component in 40, a low pass filter consisting of R10,R3,D3, and C7 of which only one, LPF1, is shown in FIG. 2. For this example, R3 is a 1.5 Megohms resistor, R10 is a 330 Kohms resistor, D3 is a 1N4148 standard diode and C7 is a 10 microfarad electrolytic capacitor. The voltage waveform created by the interaction of the output from the counter CNT1 with the low pass filter LPF1 at the junction of diode D3, R3 and C7 is shown in FIG. 4 d and constitutes the quasi triangular output of this low pass filter.

The next blocks to be analyzed are the control pulse generators, 30, 31, 32 in FIG. 1 of which only one is detailed in FIG. 2. In the present example, block 30 has two components, one operational amplifier OA1 and a high pass filter HPF1 made up of resistor R16 (220 ohms) and a capacitor C2 (0.1 microfarad) OA1 can be part of a quad operational amplifier package, for example the HA17324, made by Harris Semiconductor Co, of Melbourne, Fla., and has two inputs, one inverting and one non-inverting.

Each of the three control pulse generators 30,31,32 receives two inputs, one from the (single) ramp voltage generator 20 and another from its respective low pass filter in 40, the triangle wave generator. In effect, each of the three separate but concurrent triangular waveforms generated from block 40 and described above, are input to each of the three control pulse generators 30, 31, 32 respectively.

Referring to FIG. 2, consider the operation of OA1. First, the triangular voltage from 40 is input into the inverting input of operational amplifier, or comparator OA1. Second, the ramp voltage from generator 20 in FIG. 1 is input to the non-inverting input of OA1.

These two inputs interact to generate an output from OA1. Given the known operating characteristics of the operational amplifier, or comparator, OA1 will generate a positive pulse every time the voltage input to its non-inverting input exceeds (i.e. is more positive than) the voltage on its inverting input. Once an output is triggered, its rising edge component will be passed to the high pass filter made up of R16 and C2 to generate the signal required by the power control block.

The remaining major blocks to be described are the power control blocks 50, 51, and 52 in FIG. 1. These blocks typically contain either a single silicon controlled rectifier (SCR) (for once per power line cycle control) or two SCR's connected so that one will conduct on the positive part of the power cycle while the other will conduct on the negative part of the power cycle. Other alternatives are a TRIAC, or a combination of a low power SCR and a power FET or transistor depending on the load to be controlled and effects to be achieved. In the present example, a TRIAC such as a Texas Instruments part number TIC201E is assumed to control the power flow to the load whose power is to be varied from half cycle to half cycle in a very gradual form. All the elements recited as alternatives in this power control block have one characteristic in common, that is the ability to conduct once triggered for the duration of the power half cycle until the AC waveform crosses zero again. The trigger signal is typically low power and can energize the device at precise intervals during either the positive or negative power line voltage.

Having completed the discussion of the structure of the major blocks of the invention, the interaction of the various blocks will now be described. This will be done by applying the well known concepts of operational amplifier function, and that of the TRIAC operation.

There are two inputs to the operational amplifier OA1, a ramp to the non-inverting input and a triangle wave to the inverting input. These are compared. The first input, the ramp voltage from 20, is synchronized to, and begins its rise at the zero crossing of each half of the power line cycle. Assume that this ramp voltage rises higher at some point during the half power cycle than the triangle wave supplied to the inverting input of OA1. As soon as that condition arises a power control signal will be generated by OA1 to the TRIAC. By adjusting VR1 this condition can be made to occur for the entire 45 second period of the triangle wave for every half power cycle, i.e. there will be a power control pulse from OA1 to the TRIAC for every half power line cycle. For 60 hz power line operation this corresponds to every 8.33 milliseconds (msec) as shown in FIG. 3*c*.

Consider the influence of the triangle wave, as it changes relatively slowly, having a long 45 second cycle time or period, as compared with the ramp voltage period of about 8.33 milliseconds (msec). As the triangle wave rises, OA1 will detect the difference between the ramp and the triangle wave later in the 8.33 msec period. As the detection occurs later in the 8.33 msec period, the power pulse initiating conduction in the TRIAC will be generated later. This delayed trigger only allows a relatively short time for the TRIAC to conduct power to the load. This means that the lights will be dim, because only a small portion of the power line cycle is allowed to deliver energy and thereby heat the filaments of the lights connected to the TRIAC.

Conversely, during times when the triangle voltage is decreasing or relatively low, the power line synchronized ramp will not have far to rise until it exceeds the triangle wave voltage. This triggers OA1 early in the 8.33 msec power cycle, and therefore the conduction angle of the TRIAC will be long and the lights will be bright.

Because the triangle wave has a period of about 45 seconds, the fading period, being directly related to the triangle wave influence on operation of OA1, will also be 45 seconds. Changing the frequency of oscillator OSC1 will either increase or decrease this period. Changing the setting of VR1 will change the relative firing time of the TRIAC with respect to the overall period of the triangle wave, i.e. VR1 adjusts the "average" brightness or power delivered over the whole 45 second fading cycle.

Setting VR1 at its extreme where its resistance is 5 kohms, generates a ramp as shown in FIG. 3*d*. This flattens the voltage ramp applied to OA1 to be nearly equal to Vcc. Because the triangle wave cannot reach a voltage higher than Vdd, always lower than Vcc, the triangle wave will never preclude OA1 from generating its pulse early in the power cycle, near the zero crossing. This insures that the controlled light will be "full" on.

Figure 6:
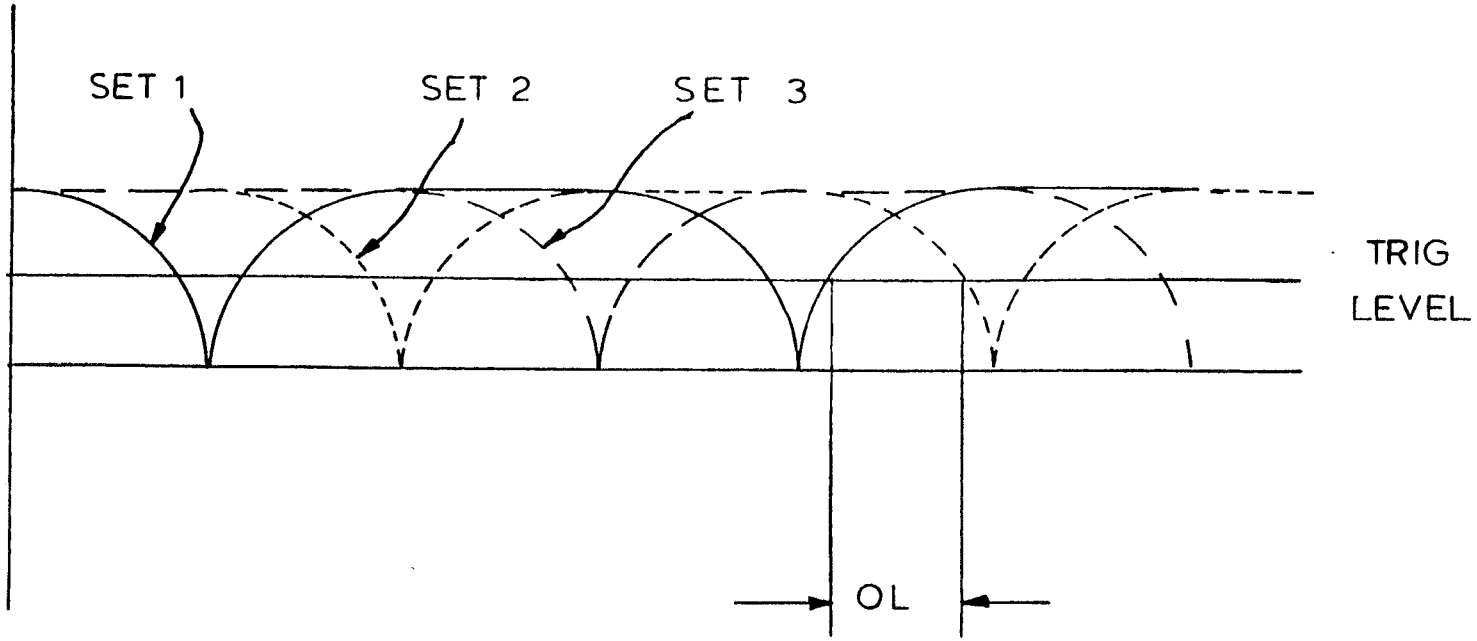
FIG. 6 shows the internal voltage waveforms associated with the concurrent operation for a three light string configuration. The trigger level and overlap influencing the operation of the fader control is shown.

It is important to note that using the voltage waveforms shown in FIGS. 3 and 4 special effects can be achieved by using the overlap of the triangular waveforms from the three low pass filters of the disclosure as shown in FIG. 6. Here, it is shown how the triangular output for light SET 1 corresponding to signals from LPF1, SET 2 corresponding from a second low pass filter, and SET 3 corresponding from a third low pass filter, overlap in time. By choosing a trigger level TRIG. LEV. for OA1 by the use of resistor VR1, the lights can be activated so as to make their fading cycles overlap. During this overlap time between strings, shown in FIG. 6 as OL, both sets 1 and 2 will be transitioning through the same intensity level, where set 1 is becoming brighter while set 2 is becoming dimmer. This overlap can be adjusted by adjusting the trigger level TRIG. LEV. up or down with VR1 of FIG. 2. This adjustment of VR1 will make it appear as if the fading cycles of the lights are changed. In reality, it is not the length of the fading cycle that changes, but rather an overlap in the point at which each of the TRIAS are triggered during the A/C power line cycle as a function of the fading cycle of the light sets. This change in trigger level and overlap gives the visual impression of a change in fading cycle. If a string of lights containing only one color light is connected to each one of the power control means corresponding to set 1, set 2 and set 3, then as the intensity of each light set changes in accordance with the output of the triangular wave, the intensity overlap between the light sets will give a varying color mix from the sum of colors of the three unicolored light sets. This effect of changing the mix of colors, or overlap, is one example of the effect that can be achieved by judicious choice of outputs for the triangular wave generating means.

Extending above example, note that the triangular waveforms generated in block 40 and shown in this description are merely illustrative of a large class of waveforms that rise to a maximum voltage from a minimum voltage and then return to the minimum voltage. The rate of rise need not be linear, nor equal from cycle to cycle, nor do the minimum and maximum voltages have to be the same from cycle to cycle. As has been explained, the length of the cycle of this generally triangular waveform generally corresponds to the length of the fading cycle of the lights, and can be varied by adjusting the value of resistor R7. Conversely, adjusting VR1, however, will adjust some of the overlap between light sets.

The slope of the triangular waveforms corresponds to the slope of the increase and decrease of the intensity of the lights to be controlled over the fading period. Given the non-linear light output of incandescent filaments as a function of applied power, and the non-linear average power delivered to the load as a function of partial power cycle conduction, it may be desirable to tailor the rise and/or fall time of the triangular slope to a non-linear function that best takes into account both these non-linearities. Other non-linearities that may be considered in determining the shape of the rise and fall times are those of the power control blocks (TRIAC drive) as it relates to the sinusoidal power delivery, those of the human visual system used to perceive the fading lights such as color perception, etc. It is therefore foreseen that the rise and fall time of the generally triangular waveform may be chosen to follow any path possible from its minimum voltage value to its maximum. It is also foreseen that each of the triangle waveforms may be chosen to be of different shapes of rise and fall times, as well as different periods to accommodate different light intensity behavior for each separate set of lights being controlled. For example, if the triangle waves were generated to have discontinuities in them, then the lights could be made to blink as well as fade concurrently, i.e. the intensity of the lights during the flashing period could be made to rise and fall over some pre-selected period of time such as 45 seconds.

The same comments also apply to the choice of waveform for the ramp generator. The waveform shown is a simple ramp produced relatively linearly by a simple RC circuit as shown in 20. However this type of rate of rise may be modified to compensate for the above listed non-linearities. By choosing a ramp that may be a an exponential, a staircase, or some non-linear, partially discontinuous function, the power delivery during the power half cycle may be controlled to achieve a desired effect.

While in the example above recitation of specific parts has been made to facilitate the understanding of this invention, the invention is not limited to such an arrangement. Rather, each of the major blocks 10, 20, 30, 40 and 50 can be expanded as desired to modify their operating characteristics, parts content or topology to perform essentially the same function as described herein. It is also contemplated that, while the disclosed circuits refer to both integrated and discrete elements, the entire circuit may be amenable to be produced as an integrated circuit, on one or more silicon, or gallium arsenide chips.

Figure 5:
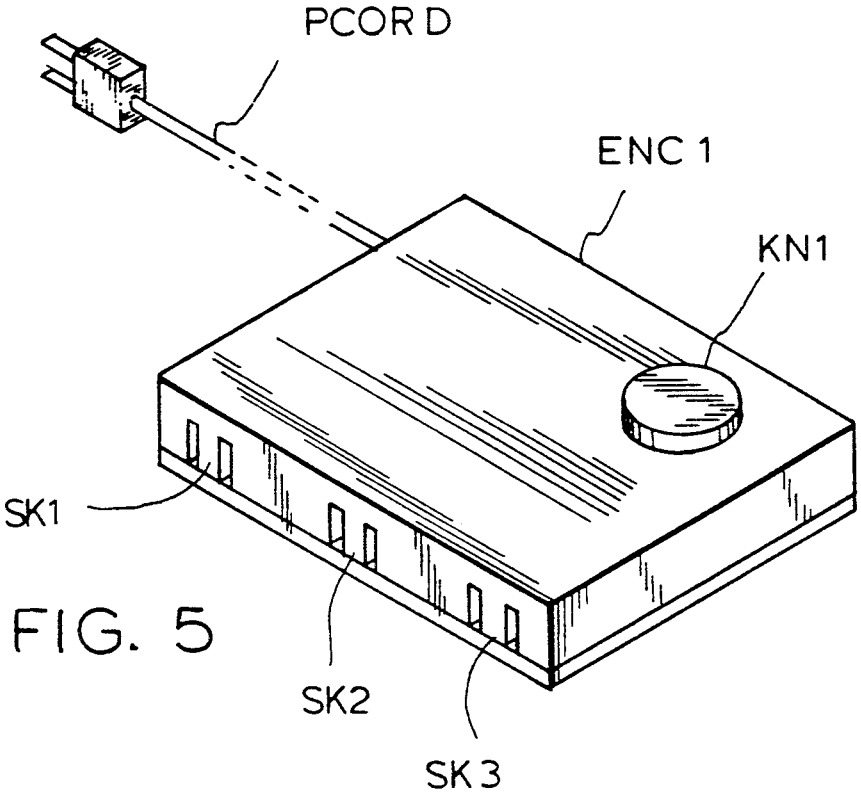
FIG. 5 shows one possible physical implementation of the lighting control system comprising a control unit and means for connecting the power source to the light strings. The control unit has an external knob for adjusting the fading cycle of the lights connected thereto.

FIG. 5 shows a convenient way of packaging the printed circuit board of the described controller in an enclosure ENC1 having an entry point for the power cord PCORD, three sockets for connecting light strings whose fading characteristics are to be controlled SK1, SK2 SK3, and an access hole (not shown) for one control knob KN1 for changing those fading characteristics. Knob KN1 mounted through the wall of the enclosure is mechanically connected to the printed circuit board of the controller to activate the wiper of variable resistor VR1, referenced in FIG. 2, and whose function it is to determine the voltage swing of the ramp generator 20, and therefore the average brightness of the light strings over the period of the fading cycle, as previously explained. The knob KN1 allows the average brightness of the lights to go from maximum, i.e. lights fully on and no fading effect, to minimum, where some of the lights are "OFF" and the fading effect is such that the fading cycle of one string of lights appears to overlap that of another string.

Yet another packaging alternative similar to FIG. 5, not shown, is to provide two adjustment knobs access holes on the enclosure, one for the average brightness connected to VR1 as described above, and the other control knob connected to R7, to adjust the period of the fading cycle from 1 to 100 seconds. By using the two knobs provided, the user now has two degrees of freedom to operate the flashing light strings connected to the controller, brightness as well as fading cycle duration. It is clear that the number of manual controls could be expanded to allow the adjustment of multiple parameters within the controller.

Figure 5A:
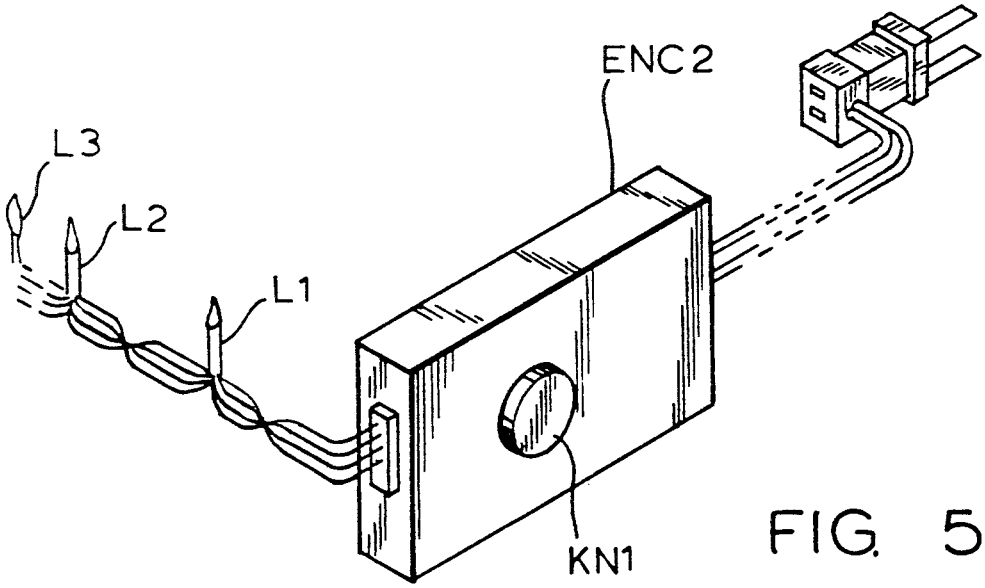
FIG. 5*a* shows an implementation of the present invention wherein the light strings are permanently attached to the controller. A knob on the controller enclosure adjusts the fading characteristics of the light strings.

Another physical embodiment is shown in FIG. 5A where the controller is packaged in an enclosure similar to the one described in FIG. 5, except that the multicolored light sets L1, L2, L3 to be controlled are permanently attached to the controller. This configuration allows the power ratings of the TRIACS to be closely matched to the load presented by the permanently attached light sets. The color of the lamps in each set or string is the same. However, every set of lights is of a different color. The colors can be chosen to facilitate the visual effects known to enhance the appearance of Christmas tree lighting. Again, one control knob KN1 on the enclosure ENC2 is shown, connected to potentiometer VR1 internal, not shown, for adjusting the average brightness of the lights over the fading cycle. Another choice, not shown, is to provide a second knob on the enclosure. This knob would again mechanically activate variable resistor R7 to adjust the duration of the fading period over from 1 to 100 seconds.

As these and other changes and additions may be made to the disclosed embodiments, reference should be had to the appended claims in determining the true scope of the invention.

I claim:

1. An ornamental lighting control system operating in conjunction with an alternating current power line having zero crossings, comprising:

a ramp generating means triggered by an alternating current power line zero crossing, said ramp generating means having a first output, said first output being a ramp having adjustable characteristics;

a triangle wave generating means having a second output, said second output being a generally triangular waveform;

a power control means responsive to a control pulse;

a control pulse generator means sensing said first output and said second output for generating said control pulse to said power control means whenever a comparison criterion between the first output and the second output is met.

2. An ornamental lighting control system operating in conjunction with an alternating current power line having zero crossings, comprising:

a power line zero crossing detector means for detecting zero crossings of said power line;

a ramp voltage generating means synchronized to said alternating current power line zero crossings by said zero crossing detector, so as to start said ramp voltage generating means at every zero crossing of said power line, said ramp voltage generator means having a first output said first output being a voltage ramp having an adjustable voltage swing;

a triangle wave generating means having a second output, said second output being a generally triangular voltage waveform;

a power control means responsive to a control signal;

a control pulse generator means sensing said first output voltage from said ramp voltage generating means and said second output from said triangular wave output means, for generating said control pulse to said power control means whenever the amplitude of the first output exceeds that of the second output.

3. A lighting system as described in claim 2 wherein the ramp generating means comprises a current source, a capacitor and a switch.

4. A lighting system as described in claim 2 wherein the ramp generating means comprises a resistor, a capacitor and a switch, 5. A lighting system as described in claim 2 wherein the triangle wave generating means comprises an oscillator, a counter and a low pass filter.

6. A lighting system as described in claim 2 wherein the control pulse generating means comprises an operational amplifier and a high pass filter.

7. A lighting system as described in claim 2 wherein the power control means comprises a TRIAC.

8. A lighting system as described in claim 2 wherein the power control means comprises a silicon controller rectifier.

9. A lighting system as described in claim 2 wherein the power line zero crossing detector comprises a full wave bridge rectifier, a current limiting means, and an optoisolator.

10. A lighting system as described in claim 9 wherein the current limiting means comprises a resistor.

11. An ornamental lighting control system operating in conjunction with an alternating current power line having zero crossings, comprising:

a power line cord having means for electrically connecting to said alternating current power line;

an enclosure having one or more power sockets and access means for said power line cord;

a ramp generating means triggered by an alternating current power line zero crossing, said ramp generating means having a first output, said first output being a ramp having manually adjustable characteristics;

a triangle wave generating means having a second output and manual means for adjusting the period of said triangle wave, said second output being a generally triangular voltage waveform;

a power control means responsive to a control pulse connected between said one or more power line sockets and said power line cord for conducting said alternating current;

a control pulse generator means sensing said first output and said second output for generating said control pulse to said power control means whenever a comparison criterion between the first output and the second output is met, thereby enabling power conduction of said alternating current said power line to said sockets.

12. An ornamental lighting control system operating in conjunction with an alternating current power line having zero crossings, comprising:

a power line cord having means for electrically connecting to said alternating current power line;

an enclosure having one or more power sockets and access means for said power line cord;

a ramp generating means triggered by an alternating current power line zero crossing, said ramp generating means having a first output, said first output being a ramp having manually adjustable voltage swing;

a triangle wave generating means having a second output, said second output being a generally triangular voltage waveform;

a power control means responsive to a control pulse, connected between said one or more power sockets and said power cord for conducting said alternating current;

a control pulse generator means sensing said first output and said second output for generating said control pulse to said power control means whenever the voltage of the first output exceeds the voltage of the second output thereby enabling conduction of said alternating current from said power line to said power sockets.

13. An ornamental lighting control system operating in conjunction with an alternating current power line having zero crossings, comprising:

a power line cord having means for electrically connecting to said alternating current power line;

sets of light strings, each light string having one or more incandescent lights;

an enclosure having access means for said power line cord and access means for one or more sets of light strings;

a ramp generating means triggered by an alternating current power line zero crossing, said ramp generating means having a first output, said first output being a ramp having a manually adjustable voltage swing;

a triangle wave generating means having a second output, said second output being a generally triangular voltage waveform;

a power control means responsive to a control pulse connected between said light strings and said power line cord for conducting said alternating current;

a control pulse generator means sensing said first output and said second output for generating said control pulse to said power control means whenever the voltage of the first output exceeds the voltage of the second output whereby said lights in each light string are activated by the power control means whenever the output of the ramp voltage is greater than the output of the generally triangular waveform.

14. A lighting system as described in claim 13 wherein each of said set of light strings are made of a single color lamp.

15. A lighting system as described in claim 13 wherein each of said set of light strings are made of different color lamps.

16. A lighting system as described in claim 13 having a plurality of triangle wave generating means a plurality of associated control pulse generator means and a plurality of power control means, wherein said voltage output of the plurality of triangle wave generating means overlap in time.

* * * * *